US008992245B2

(12) United States Patent
Higuchi et al.

(10) Patent No.: US 8,992,245 B2
(45) Date of Patent: Mar. 31, 2015

(54) CONNECTOR

(75) Inventors: Koji Higuchi, Tokyo (JP); Osamu Hashiguchi, Tokyo (JP); Yoshinori Mizusawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 89 days.

(21) Appl. No.: 13/992,350

(22) PCT Filed: Oct. 20, 2011

(86) PCT No.: PCT/JP2011/074100

§ 371 (c)(1),
(2), (4) Date: Jun. 7, 2013

(87) PCT Pub. No.: WO2012/086302

PCT Pub. Date: Jun. 28, 2012

(65) Prior Publication Data

US 2013/0260586 A1 Oct. 3, 2013

(30) Foreign Application Priority Data

Dec. 21, 2010 (JP) ..... 2010-284392

(51) Int. Cl.
*H01R 13/52* (2006.01)
*H01R 13/516* (2006.01)

(52) U.S. Cl.
CPC ..... *H01R 13/5202* (2013.01); *H01R 13/5219* (2013.01); *H01R 13/516* (2013.01)
USPC ..... 439/272

(58) Field of Classification Search
USPC ..... 439/271–272, 587–589, 752
See application file for complete search history.

(56) References Cited

U.S. PATENT DOCUMENTS 4,772,231 A * 9/1988 Hayes ..... 439/752
5,021,923 A * 6/1991 Zinn ..... 361/679.01

(Continued)

FOREIGN PATENT DOCUMENTS

EP 0 996 199 A2 4/2000
JP S63-176281 U 11/1988

(Continued)

OTHER PUBLICATIONS

International Search Report of PCT/JP2011/074100, Jan. 10, 2012.
Taiwanese Office Action dated Mar. 28, 2014 in Application No. 100138665, with English translation.

*Primary Examiner* — Jean F Duverne
(74) *Attorney, Agent, or Firm* — Collard & Roe, P.C.

(57) ABSTRACT

A connector comprises a housing extending in a front-rear direction and a sealing member attached in the housing. The housing has a rear wall located at a rear end portion of the housing and an enclosed portion extending from the rear wall in the front-rear direction. When the housing is formed by a molding process, a metal mold is used to form a plurality of seal stoppers around the enclosed portion. Each of the seal stoppers protrudes from the enclosed portion in a direction perpendicular to the front-rear direction. The housing has a plurality of holes which are formed when the metal mold is removed from the housing. Each of the holes pierces the rear wall in the front-rear direction. The holes face the respective seal stoppers in the front-rear direction. The sealing member is attached to the enclosed portion so as to be located between the rear wall and the seal stoppers in the front-rear direction. The front sides of the holes are covered by the sealing member.

6 Claims, 6 Drawing Sheets

(56) References Cited

U.S. PATENT DOCUMENTS

| | | | | |
|---|---|---|---|---|
| 5,358,420 | A * | 10/1994 | Cairns et al. | 439/206 |
| 6,152,752 | A | 11/2000 | Fukuda | |
| 6,203,348 | B1 * | 3/2001 | Fukuda | 439/275 |
| 6,210,191 | B1 * | 4/2001 | Sai | 439/274 |
| 6,409,541 | B1 * | 6/2002 | Hattori et al. | 439/587 |
| 7,029,328 | B1 * | 4/2006 | Mckenzie et al. | 439/587 |
| 7,033,216 | B2 * | 4/2006 | Ito | 439/587 |
| 7,104,840 | B2 * | 9/2006 | Murakami | 439/587 |
| 7,597,580 | B1 * | 10/2009 | Advey et al. | 439/383 |

FOREIGN PATENT DOCUMENTS

| | | | |
|---|---|---|---|
| JP | H3-040775 | U | 4/1991 |
| JP | 7-94234 | A | 4/1995 |
| JP | 10-83858 | A | 3/1998 |
| JP | 2000-133367 | A | 5/2000 |
| JP | 2004-63179 | A | 2/2004 |
| JP | 2006-244902 | A | 9/2006 |

* cited by examiner

CONNECTOR

CROSS REFERENCE TO RELATED APPLICATIONS

This application is the National Stage of PCT/JP2011/074100 filed on Oct. 20, 2011, which claims priority under 35 U.S.C. §119 of Japan Application No. 2010-284392 filed on Dec. 21, 2010, the disclosure of which is incorporated by reference. The international application under PCT article 21(2) was not published in English.

TECHNICAL FIELD

This invention relates to a connector having a water-proof function.

BACKGROUND ART

Generally, a connector, which has a water-proof function, is provided with a sealing member. When the connector is mated with a mating connector, the sealing member is sandwiched by a housing of the connector and a housing (mating housing) of the mating connector so as to fill a gap between the housing of the connector and the housing of the mating connector.

For example, the connector provided with the aforementioned sealing member is disclosed in Patent Document 1. As shown in FIG. 11, the connector of Patent Document 1 has a retainer attached to a mating side of a housing, and a sealing member attached between a rear wall of the housing and the retainer. The retainer of the connector of Patent Document 1 regulates a forward movement of the sealing member.

PRIOR ART DOCUMENTS

Patent Document(s)

Patent Document 1: JP A 2004-63179

SUMMARY OF INVENTION

Technical Problem

However, in some cases, it is difficult to form a connector so as to be attachable with a retainer. In these cases, the housing itself should be provided with a movement-regulation structure which regulates a movement of a sealing member.

An existing housing shaped in a cylindrical shape is unable to be provided with a simply configured movement-regulation structure therewithin. When the existing housing is provided with a movement-regulation structure, a metal mold for forming the housing is required to have a complicated structure so that a cost may be high.

It is therefore an object of the present invention to provide a connector comprising a new structure, wherein a housing itself has a structure for regulating a movement of a sealing member.

Solution to Problem

One aspect of the present invention provides a connector comprising a housing and a sealing member attached in the housing. The housing has a rear wall, a plurality of holes, an enclosed portion, a plurality of seal stoppers and an enclosure, wherein the holes pierce the rear wall in a front-rear direction, the enclosed portion extends forward from the rear wall, the seal stoppers are provided on a periphery of the enclosed portion in a direction perpendicular to the front-rear direction so as to correspond to the holes in the front-rear direction, respectively, and the enclosure extends forward from the rear wall while enclosing the enclosed portion and the seal stoppers in a plane perpendicular to the front-rear direction. The sealing member is attached to the periphery of the enclosed portion so as to be located between the rear wall and the seal stopper in the front-rear direction. The sealing member covers the holes.

Advantageous Effects of Invention

According to the present invention, a housing is provided with a plurality of holes on a rear wall thereof. These holes are used to form seal stoppers for regulating a movement of a sealing member on an enclosed portion which is enclosed by an enclosure. According to the present invention, it is therefore possible to form the seal stoppers without increasing a cost. Moreover, the holes are covered by the sealing members so that no problem damaging a water-proof structure is caused.

An appreciation of the objectives of the present invention and a more complete understanding of its structure may be had by studying the following description of the preferred embodiment and by referring to the accompanying drawings.

DESCRIPTION OF EMBODIMENTS

Figure 1:
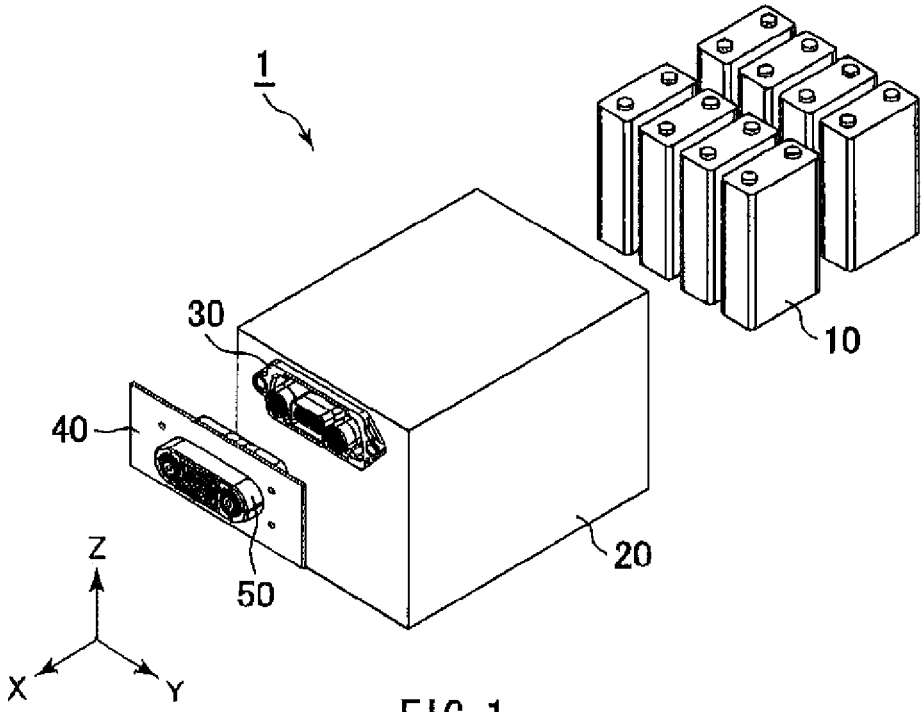
FIG. 1 is a perspective view schematically showing a system comprising a connector combination according to an embodiment of the present invention as an interface for a storage battery module.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Referring to FIG. 1, a connector combination according to an embodiment of the present invention is used in a system which includes a storage battery module 1. The connector combination comprises a receptacle (connector) 30 and a plug 50, wherein the receptacle 30 is attached to a module box 20 which accommodates a storage battery 10, and the plug 50 is attached to a panel 40. The connector combination according to the present embodiment has a water-proof function. The receptacle 30 according to the present embodiment has one of essential features related to a water-proof structure.

As can be seen from FIGS. 1 to 4, the receptacle 30 and the plug 50, which constitute the connector combination, are mateable with each other and removable from each other along the X-direction (front-rear direction). In the following description, a side, which is a part of the receptacle 30 and is configured to be mated with the plug 50 (mating connector), is referred to as a front side while its opposite side is referred to as a rear side. Accordingly, as for the receptacle 30, the positive X-direction is directed forward while the negative X-direction is directed rearward. Hereinafter, an explanation is made about a structure related to the water-proof function of the receptacle 30 with reference to the drawings.

As shown in FIGS. 5 to 9, the receptacle 30 according to the present embodiment comprises a housing 100 made of an insulating material, two power contacts 200 each made of a metal, two springs 250 each made of a metal, a sealing member 300 having a ring-like shape and made of an elastic member, C-type retaining rings (fixing members) 260 each made of a metal, and an intermediary connector 400. Each of the power contacts 200 is held by the housing 100 so as to extend forward. The sealing member 300 is attached in the housing 100. The receptacle 30 may comprise a metal ring (for example, an E-type retaining ring) other than the C-type retaining ring 260. Moreover, the receptacle 30 may comprise a fixing member other than the metal ring. However, considering its small sire in the X-direction, it is preferred to comprise the metal ring rather than the other fixing member. In addition, considering a capability as a fixing member, it is preferred to comprise the C-type retaining ring 260 rather than the E-type retaining ring or the like.

As can be seen from FIGS. 6 to 9, the housing 100 has a rear wall 110, an enclosed portion 120, two contact-enclosures 140, an intermediary-connector enclosure 150, an enclosure 160 and a flange 165, wherein the enclosed portion 120 extends forward from the rear wall 110, the contact-enclosures 140 further extend forward from the enclosed portion 120, the intermediary-connector enclosure 150 is located between the two contact-enclosures 140, the enclosure 160 extends forward from the rear wall 110, and the flange 165 is formed on a front end of the enclosure 160. The two contact-enclosures 140 cover the two power contacts 200, respectively. The flange 165 is used when the receptacle 30 is attached to the module box 20.

Figure 6:
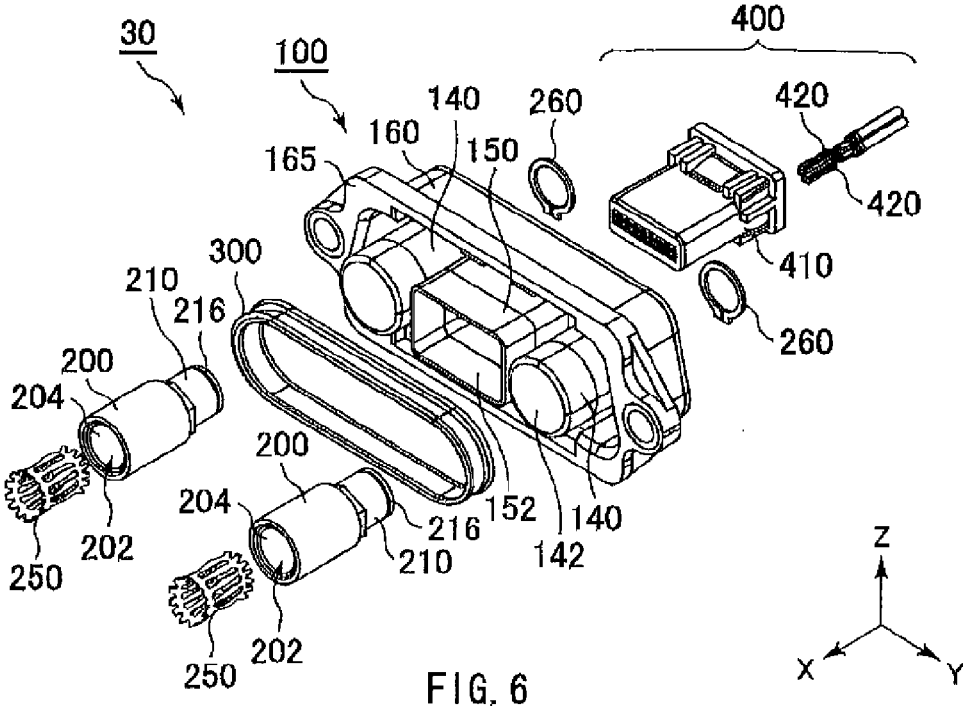
FIG. 6 is an exploded, perspective view showing the receptacle of FIG. 5.
Figure 9:
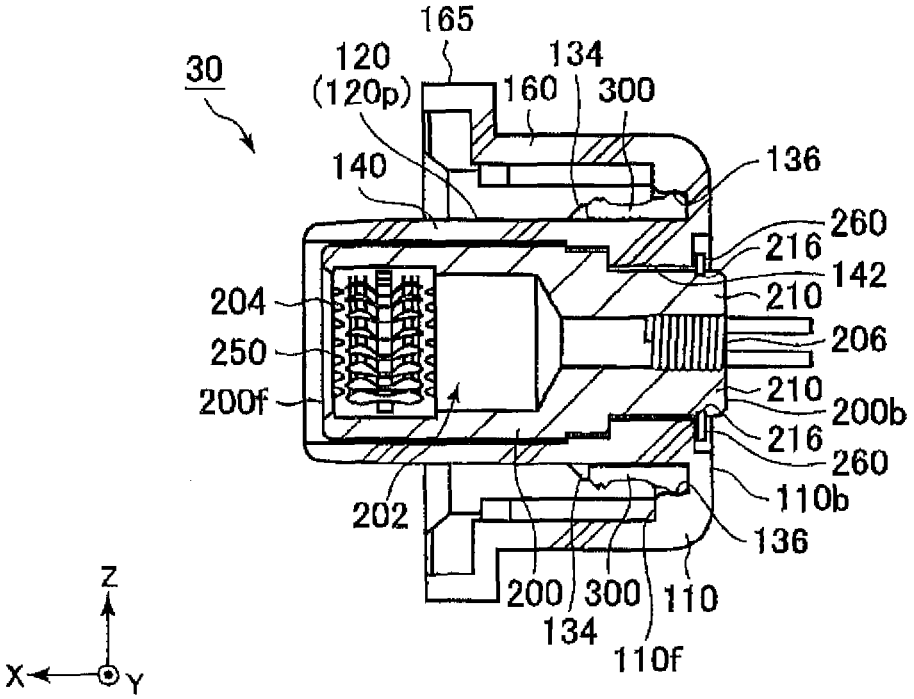
FIG. 9 is a cross-sectional view showing the receptacle of FIG. 8, taken along line IX-IX.

As can be seen from FIGS. 6 and 9, the rear wall 110 is formed with two contact holding holes 142 and one intermediary-connector holding hole 152. Each of the contact holding holes 142 and the intermediary-connector holding hole 152 pierces the rear wall 110 along the front-rear direction. The contact holding hole 142 is located within the contact-enclosure 140 in the YZ-plane. The intermediary-connector holding hole 152 is located within the intermediary-connector enclosure 150 in the YZ-plane.

Figure 10:
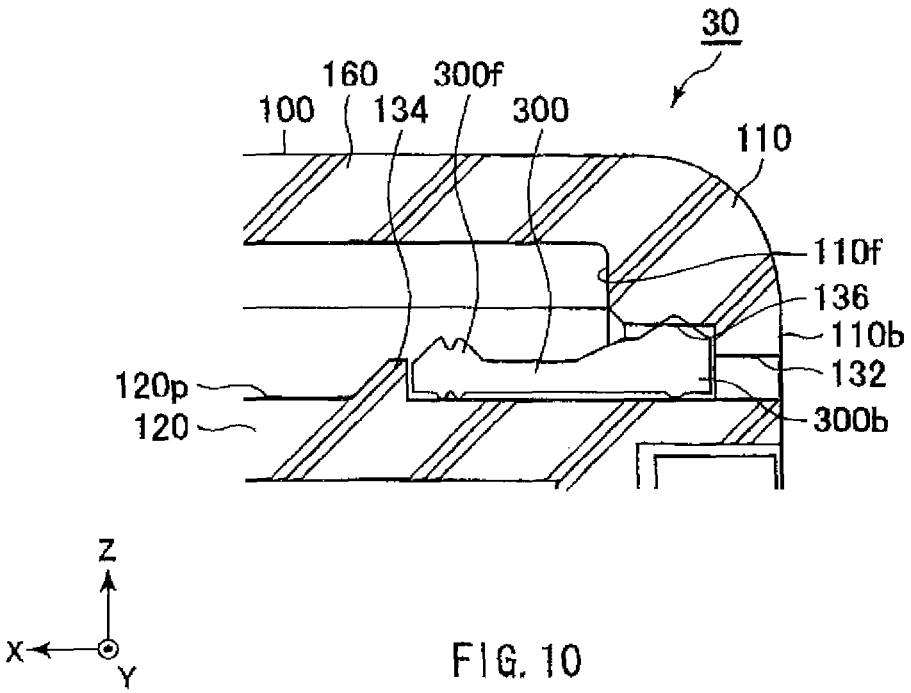
FIG. 10 is an enlarged, cross-sectional view showing a seal stopper of the receptacle of FIG. 5 and the vicinity of the seal stopper.
Figure 11:
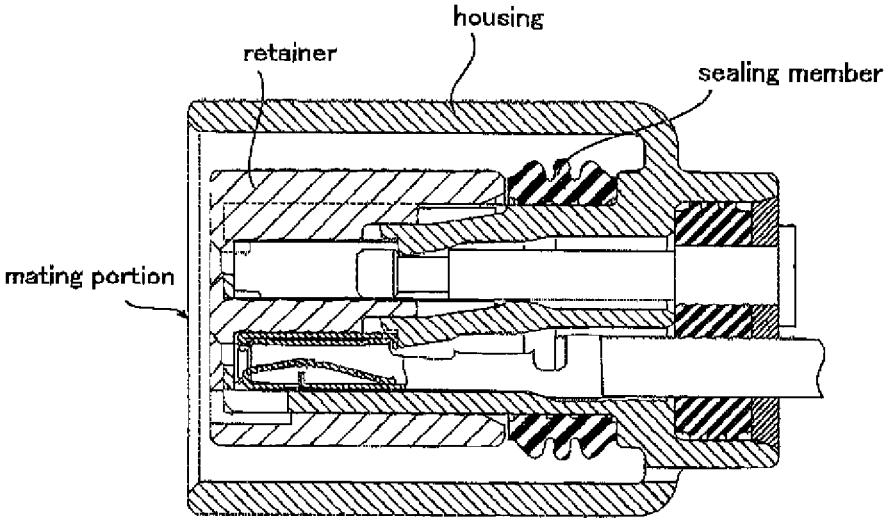
FIG. 11 is a cross-sectional view showing the connector of Patent Document 1.

As shown in FIG. 10, the housing 100 is formed with a plurality of holes 132 which pierce the rear wall 110 in the X-direction. The hole 132 has a rectangular shape in the YZ-plane. A partial surface (for example, a lower surface of the hole 132 of FIG. 10), which is a part of the inside surface of the hole 132 and is near to the center of the housing 100, is flush with a periphery 120*p* of the enclosed portion 120.

As shown in FIG. 10, the periphery 120*p* of the enclosed portion 120 is provided with a plurality of seal stoppers 134 each of which protrudes in a direction (a direction directed toward the enclosure 160) perpendicular to the X-direction. The seal stoppers 134 correspond to the holes 132, respectively. More specifically, each of the seal stoppers 134 is located forward of the corresponding hole 132 when seen from a rear surface 110*b* of the rear wall 110 of the housing 100. In other words, the seal stoppers 134 are provided on the periphery 120*p* of the enclosed portion 120 in a direction perpendicular to the X-direction so as to correspond to the holes 132 in the X-direction, respectively. In general, when a housing is formed by using two metal molds, it is difficult to form a seal stopper, which regulates a movement of a sealing member, on an enclosed portion enclosed by an enclosure. However, when the holes 132 are formed as described above, the seal stoppers 134 may be easily provided. In detail, the holes 132 are traces of a metal mold which is removed to form the seal stoppers 134 when the housing 100 is formed by a molding process. When the two metal molds are removed from each other along the X-direction, parts of the metal mold which form rear surfaces of the seal stoppers 134 pass along the X-direction to leave the traces or holes 132, An illustrated front surface of the seal stopper 134 is oblique to both the X-direction and a protruding direction of the seal stopper 134 (for example, the Z-direction of the seal stopper 134 of FIG. 10). In other words, the front surface of the seal stopper 134 is a slope oblique to the front-rear direction. On the other hand, the rear surface of the seal stopper 134 is a plane perpendicular to the X-direction. The seal stopper 134 has a rectangular shape in the YZ-plane. As previously described, the hole 132 is the trace of the metal mold which is used when the seal stopper 134 is molded. Accordingly, the rear surface of the seal stopper 134 has almost the same size as the hole 132 in the YZ-plane.

The rear wall 110 is formed with a plurality of ditches 136 which are recessed rearward from the front surface 110*f*. As shown in FIG. 10, the ditches 136 communicate with the holes 132, respectively. The ditch 136 is larger than the hole 132 in a direction perpendicular to the X-direction (for example, the Z-direction of FIG. 10). The ditches 136 according to the present embodiment are formed over a full circumference of the periphery 120*p* of the enclosed portion 120.

Figure 7:
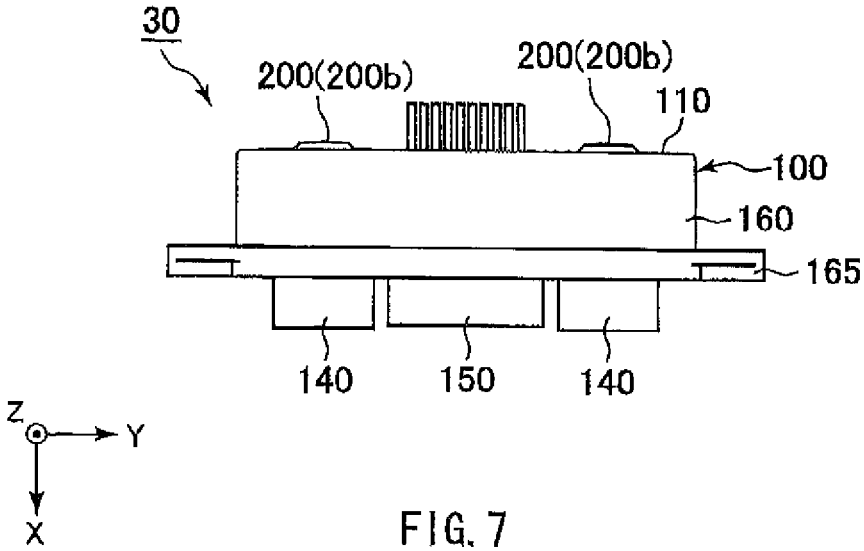
FIG. 7 is a top view showing the receptacle of FIG. 5.
Figure 8:
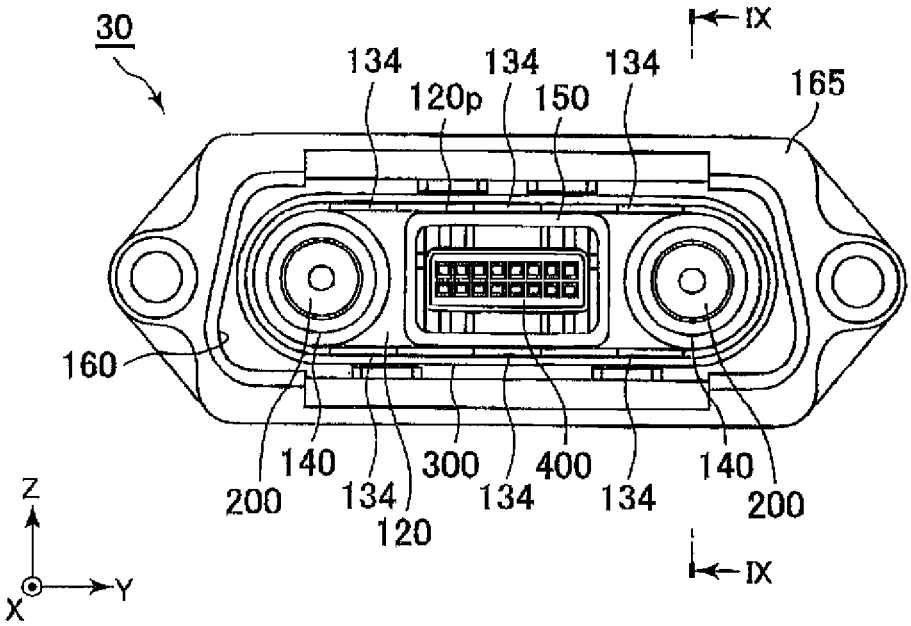
FIG. 8 is a front view showing the receptacle of FIG. 5.

As can be seen from FIGS. 9 and 10, the enclosure 160 encloses the enclosed portion 120 and the seal stoppers 134 in the YZ-plane. The flange 165, which is the front end of the enclosure 160, is located rearward of the contact-enclosures 140 and the intermediary-connector enclosure 150. In other words, as shown in FIG. 7, the contact-enclosures 140 and the intermediary-connector enclosure 150 protrude forward beyond the enclosure 160. Moreover, the contact-enclosures 140 protrude forward beyond the intermediary-connector enclosure 150.

Referring to FIGS. 6 and 9, the power contact 200 is formed with a contact receiver 202 which is configured to receive a power contact 700 of the mating connector or the plug 50. The contact receiver 202 is provided with an attached portion 204 at a front end thereof. The attached portion 204 is attached with the spring 250.

The power contact 200 has a held portion 210 held in the contact holding hole 142, and a fixed portion 216 formed behind the held portion 210.

The held portion 210 has an external form corresponding to the contact holding hole 142. The held portion 210 is inserted into the contact holding hole 142 from the front (i.e. according to the present embodiment, along the negative X-direction) so that the power contact 200 is held by the housing 100.

The fixed portion 216 is a ditch recessed toward the center of the power contact 200 in a radius direction. A width (a length in the X-direction) of the ditch, which constitutes the fixed portion 216, corresponds to a thickness of the C-type retaining ring 260. The C-type retaining ring 260 is attached to the fixed portion 216 under a state where the held portion 210 is inserted in the contact holding hole 142 so that the power contact 200 is fixed to and held by the housing 100.

The sealing member 300 is attached to the periphery 120*p* of the enclosed portion 120 so as to be located between the ditches 136 of the rear wall 110 and the seal stoppers 134 in the X-direction. In detail, as shown in FIG. 10, a front end 300*f* of the sealing member 300 is brought into abutment with the rear surfaces of the seal stoppers 134 while a rear end 300*b* of the sealing member 300 is accommodated in the ditches 136. In other words, the sealing member 300 is sandwiched by the seal stoppers 134 and the ditches 136 in the X-direction so that a movement of the sealing member 300 in the X-direction is regulated. According to the present embodiment, the rear end 300*b* of the sealing member 300 is accommodated in and held by the ditches 136 so that the sealing member 300 is prevented from being out of position.

The sealing member 300 covers the holes 132 from the front under a state where the rear end 300*b* is accommodated in the ditches 136. The sealing member 300 is configured so that only the rear end 300*b* is visible when the holes 132 are seen from the rear surface 110*b* of the rear wall 110. Accordingly, the holes 132 cause no problem damaging the waterproof structure.

The sealing member 300 is attached by inserting the sealing member 300 from a front side of the housing 100. As previously described, the front surface of the seal stopper 134 is a slope so that the sealing member 300 is able to be inserted relatively easily. The rear surface of the seal stopper 134 is perpendicular to the X-direction so that the sealing member 300 is not removed easily when once the sealing member 300 is inserted to be attached.

As shown in FIG. 6, the intermediary connector 400 comprises en intermediary housing 410 and signal contacts 420 which are connected to a cable and held by the intermediary housing 410. The intermediary connector 400 is configured to be inserted in the intermediary-connector holding hole 152 from the rear surface 110*b* of the rear wall 110 of the housing 100 so that the intermediary connector 400 is attachably/detachably held by the housing 100.

Figure 2:
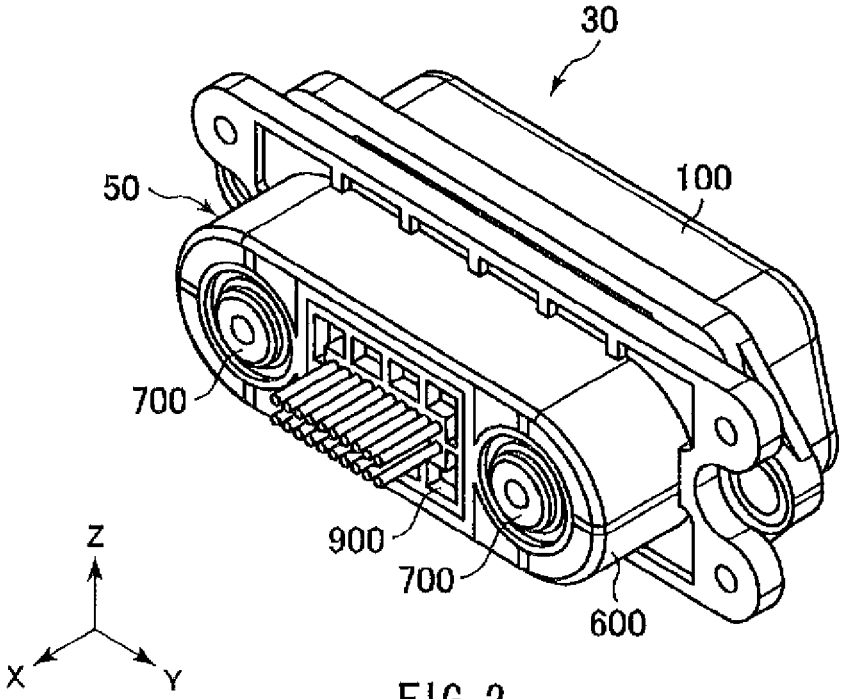
FIG. 2 is a perspective view showing the connector combination used in the system of FIG. 1.
Figure 3:
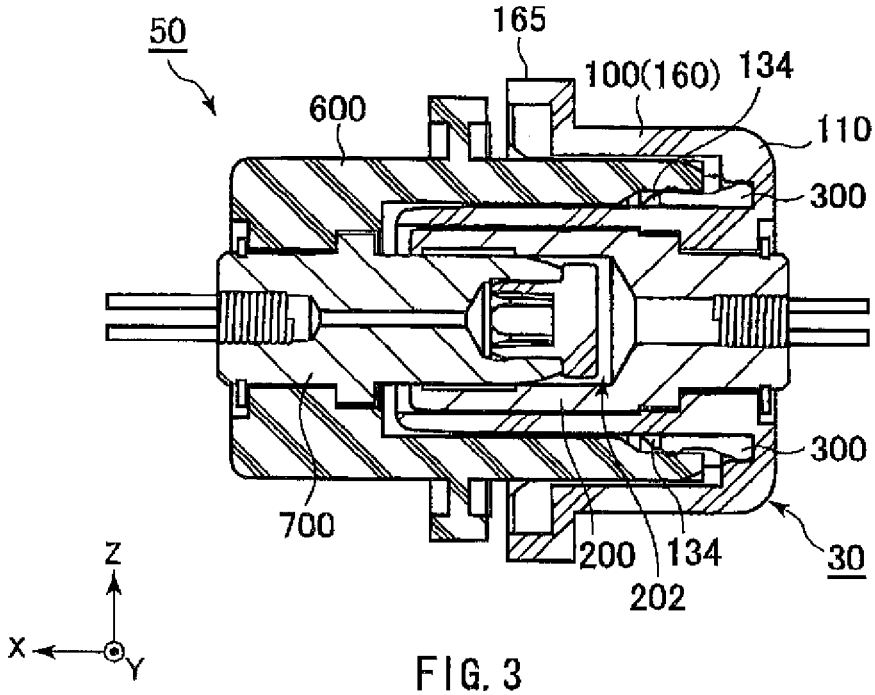
FIG. 3 is a cross-sectional view showing a power contact of the connector combination of FIG. 2 and the vicinity of the power contact.
Figure 4:
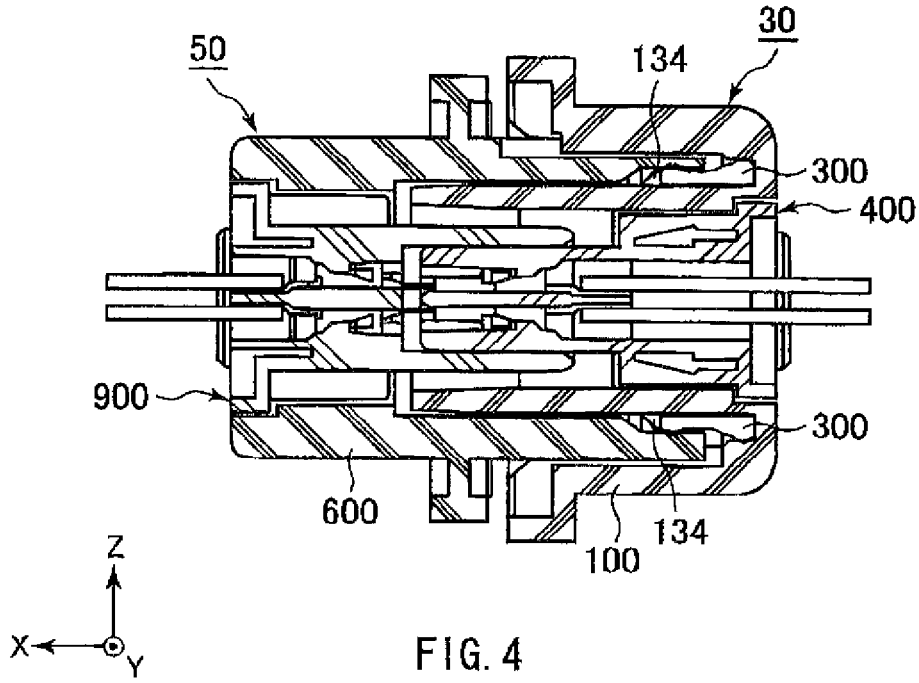
FIG. 4 is a cross-sectional view showing a signal contact of the connector combination of FIG. 2 and the vicinity of the signal contact.
Figure 5:
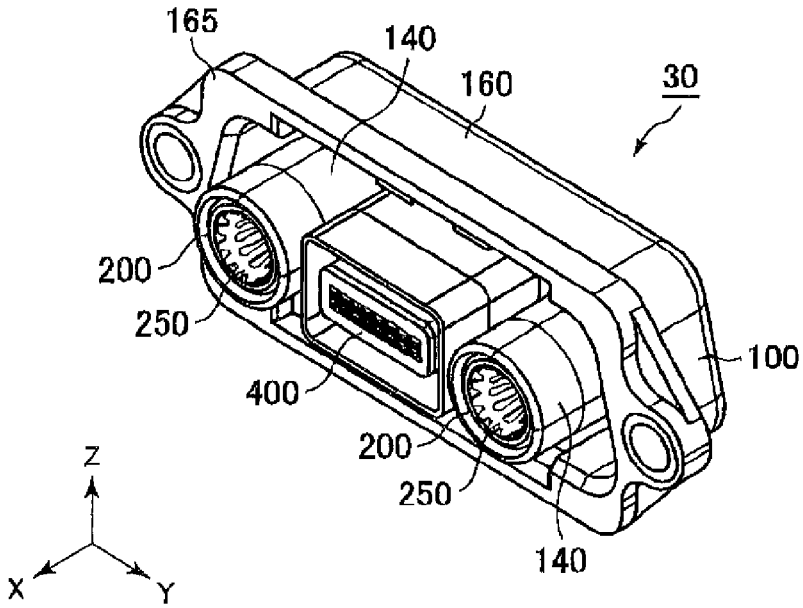
FIG. 5 is a perspective view showing a receptacle (connector) which constitutes one of connectors of the connector combination of FIG. 1.

As shown in FIGS. 2 to 4, the plug 50 according to the present embodiment comprises a housing 600 made of an insulating material, two power contacts 700 each made of a metal and an intermediary connector 900. The power contact 700 is connected to the power contact 200 when the plug 50 is mated with the receptacle 30. Similarly, the intermediary connector 900 is connected to the intermediary connector 400 installed in the receptacle 30 when the plug 50 is mated with the receptacle 30.

As described in reference to FIG. 7, the contact-enclosure 140 or the like (the contact-enclosures 140 and the intermediary-connector enclosure 150) of the receptacle 30 according to the present embodiment protrudes beyond the enclosure 160. Accordingly, when the receptacle 30 is mated with the plug 50, the housing 600 of the plug 50 is mated with the contact-enclosure 140 or the like before mated with the enclosure 160. Thus, the connector combination according to the present embodiment is roughly and temporarily positioned by the contact-enclosure 140 or the like of the receptacle 30. Then, the housing 600 of the plug 50 is inserted into the enclosure 160 so that the connector combination is further positioned. Accordingly, the sealing by the sealing member 300 is more securely done while the mating operation is more easily done.

According to the aforementioned embodiment, the ditches 136 are provided to hold the rear end 300*b* of the sealing member 300. However, it is possible to configure without the ditches 136. For example, the sealing member 300 may be provided with protruding portions which are inserted in the holes 132 while the ditches 136 are not provided. In this case, the protruding portion of the sealing member 300 is required to also have a function for filling the hole 132. Accordingly, the protruding portion of the sealing member 300 should have a shape corresponding to the hole 132 in the YZ-plane. Moreover, the receptacle 30 may comprise both the protruding portion and the aforementioned ditch 136 instead of being provided with only one of them.

The present application is based on a Japanese patent application of JP2010-284392 filed before the Japan Patent Office on Dec. 21, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

Reference Signs List

1 storage battery module
10 storage battery
20 module box
30 receptacle (connector)
40 panel
50 plug
100 housing
110 rear wall
110*f* front surface
110*b* rear surface
120 enclosed portion
120*p* peripheral portion
132 hole
134 seal stopper
136 ditch
140 contact-enclosure
142 contact holding hole
150 intermediary-connector enclosure
152 intermediary-connector holding hole
160 enclosure
165 flange
200 power contact
200*f* front end
200*b* rear end
202 contact receiver
204 attached portion
210 held portion
216 fixed portion
250 spring
260 C-type retaining ring (fixing member)
300 sealing member
300*f* front end
300*b* rear end
400 intermediary connector
410 intermediary housing
420 signal contact

600 housing
700 power contact
900 intermediary connector

The invention claimed is:

1. A connector mateable with a mating connector, the connector comprising:

a housing having a rear wall, a plurality of holes, an enclosed portion, a plurality of seal stoppers and an enclosure, the holes piercing the rear wall in a front-rear direction, the enclosed portion extending forward from the rear wall, the seal stoppers being provided on a periphery of the enclosed portion in a direction perpendicular to the front-rear direction so as to correspond to the holes in the front-rear direction, respectively, the enclosure extending forward from the rear wall while enclosing the enclosed portion and the seal stoppers in a plane perpendicular to the front-rear direction; and a sealing member attached in the housing, the sealing member being attached to the periphery of the enclosed portion so as to be located between the rear wall and the seal stoppers in the front-rear direction, the sealing member covering the holes.

2. The connector as recited in claim 1, wherein the seal stopper protrudes in a direction perpendicular to the front-rear direction from the periphery of the enclosed portion.

3. The connector as recited in claim 1, wherein:

the rear wall is formed with ditches on a front surface thereof, the ditches being recessed rearward so as to communicate with the holes, respectively; and a rear end of the sealing member is accommodated in the ditches.

4. The connector as recited in claim 3, wherein the ditches are formed over a full circumference of the periphery of the enclosed portion.

5. The connector as recited in claim 3, wherein the ditch is larger than the hole in a direction perpendicular to the front-rear direction.

6. The connector as recited in claim 1, the connector further comprising a power contact which is held by the housing so as to extend forward, wherein:

the housing is provided with a contact-enclosure which covers the power contact; and the contact-enclosure protrudes forward beyond the enclosed portion and the enclosure.

* * * * *